US008879946B2

(12) United States Patent
Watanabe

(10) Patent No.: US 8,879,946 B2
(45) Date of Patent: Nov. 4, 2014

(54) IMAGE-FORMING APPARATUS WITH A BIAS APPLYING UNIT FOR SWITCHING BETWEEN A FIRST BIAS FOR REMOVING RESIDUAL TONER AND A SECOND BIAS FOR EXPELLING RESIDUAL TONER

(75) Inventor: Takeshi Watanabe, Osaka (JP)

(73) Assignee: Kyocera Document Solutions Inc. (JP)

( * ) Notice: Subject to any disclaimer, the term of this patent is extended or adjusted under 35 U.S.C. 154(b) by 342 days.

(21) Appl. No.: 13/433,496

(22) Filed: Mar. 29, 2012

(65) Prior Publication Data

US 2012/0257910 A1 Oct. 11, 2012

(30) Foreign Application Priority Data

Apr. 6, 2011 (JP) ..... P2011-084639

(51) Int. Cl.
*G03G 15/16* (2006.01)
*G03G 15/01* (2006.01)

(52) U.S. Cl.
CPC ..... *G03G 15/161* (2013.01); *G03G 2215/0132* (2013.01); *G03G 15/0189* (2013.01)
USPC ..... 399/101

(58) Field of Classification Search
USPC ..... 399/101, 297, 353, 354
See application file for complete search history.

(56) References Cited

U.S. PATENT DOCUMENTS

| | | | | |
|---|---|---|---|---|
| 7,295,796 | B1 | 11/2007 | Murakami et al. | 399/150 |
| 7,433,626 | B2 * | 10/2008 | Takeuchi | 399/101 |
| 7,860,429 | B2 * | 12/2010 | Ishikawa et al. | 399/101 |
| 8,185,011 | B2 * | 5/2012 | Shibuya et al. | 399/101 |

FOREIGN PATENT DOCUMENTS

| | | |
|---|---|---|
| JP | 9-325623 | 12/1997 |
| JP | 2004-170555 | 6/2004 |
| JP | 2006-227159 | 8/2006 |
| JP | 2007-272091 | 10/2007 |

* cited by examiner

*Primary Examiner* — William J Royer
(74) *Attorney, Agent, or Firm* — Ostrolenk Faber LLP

(57) ABSTRACT

An image-forming apparatus for forming an image on a recording medium includes an image carrier for carrying a toner image corresponding to an image to be formed on the recording medium, a cleaning device including a cleaning member for cleaning the image carrier by removing residual toner remaining on an image-carrying face, and a bias-applying unit for applying a first bias for removing residual toner charged to a first polarity by electrostatic force from the image carrier such that the cleaning member captures residual toner, and expelling the residual toner charged to a second polarity, which is an opposite polarity to the first polarity, by electrostatic force from the cleaning member toward the image carrier, between the image carrier and the cleaning member.

6 Claims, 7 Drawing Sheets

IMAGE-FORMING APPARATUS WITH A BIAS APPLYING UNIT FOR SWITCHING BETWEEN A FIRST BIAS FOR REMOVING RESIDUAL TONER AND A SECOND BIAS FOR EXPELLING RESIDUAL TONER

BACKGROUND OF THE DISCLOSURE

Priority is claimed on Japan Patent Application No. 2011-084639, filed on Apr. 6, 2011, the content of which is incorporated herein by reference.

FIELD OF THE DISCLOSURE

The present disclosure relates to an image-forming apparatus that forms an image on a recording medium such as printing paper.

DESCRIPTION OF THE RELATED ART

As is well known, an image-forming apparatus such as a copier, a printer, a facsimile, and a complex device that performs the functions of all these devices, forms an image on a recording medium by forming a toner image corresponding to the image to be formed, and then transferring and affixing this toner image to the recording medium. Methods of transferring a toner image to a recording medium are classified broadly into a direct transfer method and an intermediate transfer method.

In the direct transfer method, the toner image is formed on an image carrying member and transferred directly onto the recording medium. For example, there are cases where a toner image formed on a photosensitive drum is transferred to printing paper. On the other hand, in the intermediate transfer method, a toner image formed elsewhere than on a transfer member is transferred to a transfer member (intermediate transfer member), and then transferred onto the recording medium. For example, there are cases where a toner image formed on a photosensitive drum is temporarily transferred to an intermediate transfer belt, and then transferred to printing paper.

In each of the transfer methods mentioned above, if scattered toner and untransferred toner remain on the transfer member, the image-forming quality (printing quality) will deteriorate. Accordingly, an image-forming apparatus includes a cleaning device for removing residual toner from the transfer member. Most cleaning devices remove residual toner by making a cleaning blade and a fur brush roller abut against the transfer member.

A cleaning device with a cleaning blade removes residual toner by making the edge of the cleaning blade abut directly against the transfer member. Thus there is a danger of damaging the surface of the transfer member if there is infiltration by foreign matter. An additional drawback is the increased drive load of the transfer member. In contrast, by rolling the fur brush roller with a bias being applied, a cleaning device with a fur brush roller removes residual toner from the transfer member by the physical scraping force and electrostatic force of the fur brush roller. It is therefore advantageous in that it is less damaging to the transfer member, and has a smaller drive load, than when using a cleaning blade.

Toner is not uniformly charged: there is toner that is almost uncharged, and toner that is charged to the reverse polarity. Since these sorts of toner are particularly common in toner that has been physically removed from the transfer member, in a cleaning device with a fur brush roller, toner remains on the fur brush roller. As a countermeasure, a technique is disclosed for maintaining the performance of a brush by applying a positive bias and a reverse bias to the brush and collecting all toner that is not uniformly charged. Additionally, a technique is disclosed for maintaining brush performance by providing a brush which a positive bias is applied to and a brush which a reverse bias is applied to.

However, since a positive bias and a reverse bias must be applied to collect toner charged to a normal polarity and toner charged to a reverse polarity from the brush, there is a problem of increased cost. Also, due to the need for a brush which a positive bias is applied to and a brush which a reverse bias is applied to, there are problems not only of increased cost but the need for installation space for two brushes, which causes an increase of the size of the apparatus.

SUMMARY

The present disclosure has been realized in view of the above issues, and aims to provide an image-forming apparatus that can form a stable and high-quality image with simple control, without greatly increasing the cost or the size of the apparatus.

In order to solve the problems described above, the present disclosure provides an image-forming apparatus for forming an image on a recording medium including an image carrier for carrying a toner image corresponding to an image to be formed on the recording medium, a cleaning device including a cleaning member for removing residual toner remaining on an image-carrying face of the image carrier by contacting the image-carrying face while rotating, and a bias-applying unit for switching between a first bias for removing residual toner remaining on the image-carrying face of the image carrier by electrostatic force from the image carrier such that the cleaning member captures the residual toner, and a second bias for expelling residual toner captured by the cleaning member by electrostatic force from the cleaning member toward the image carrier, and for applying the first bias or the second bias between the image carrier and the cleaning member. The polarities of the first bias and the second bias are the same, and the value of the second bias is greater than the value of the first bias.

According to the image-forming apparatus of the present disclosure, by applying a first bias between the image carrier and the cleaning member, residual toner remaining on the image-carrying face of the image carrier is removed by electrostatic force from the image carrier such that the cleaning member captures the residual toner, and, by applying a second bias, residual toner being captured by the cleaning member is expelled by electrostatic force from the cleaning member toward the image carrier. Therefore, it is possible to provide an image-forming apparatus that can form a stable and high-quality image with simple control, without greatly increasing the cost or the size of the apparatus.

DETAILED DESCRIPTION OF THE DISCLOSURE

An image-forming apparatus according to an embodiment of the present disclosure is described in detail with reference to the drawings. While the following explanation describes a color printer as an example of an image-forming apparatus, the present disclosure can also be applied in a black-and-white printer, and in an image-forming apparatus other than a printer, such as a copier, a facsimile, and a complex device.

Overall Configuration of Image-Forming Apparatus

Figure 1:
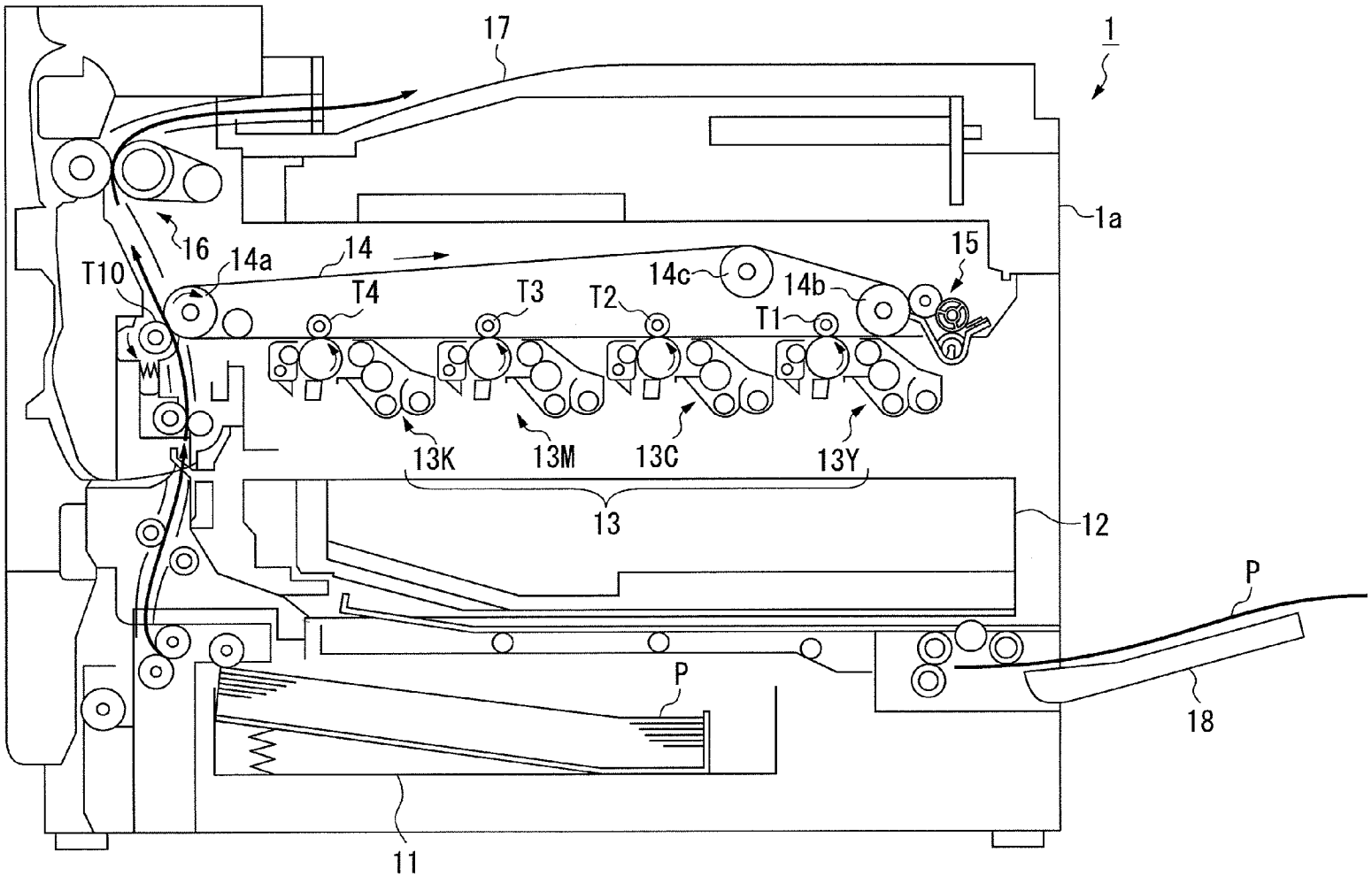
FIG. 1 is a cross-sectional diagram showing the structure of a color printer as an image-forming apparatus according to an embodiment of the present disclosure.

FIG. 1 is a cross-sectional diagram showing the configuration of a color printer as an image-forming apparatus according to an embodiment of the present disclosure. As shown in FIG. 1, a color printer 1 includes a paper-feeding cassette 11, a laser scanner unit (LSU) 12, an image-forming unit 13, an intermediate transfer belt 14 (image carrier), a cleaning device 15, a fusing device 16, and the like, inside a box-shaped apparatus body 1*a*, and prints, for example, an image corresponding to printing data input from outside the apparatus body 1*a* onto predetermined printing paper P (recording medium).

The paper-feeding cassette 11 can store a plurality of (e.g. approximately several hundreds) standard-type printing paper P, and is provided in the bottom part of the apparatus body 1*a* such that the paper-feeding cassette 11 can be pulled open from the front face of the apparatus body 1*a*. The laser scanner unit 12 irradiates laser lights generated from light sources in accordance with, for example, inputted printing data, to the image-forming unit 13. Specifically, the laser scanner unit 12 irradiates a total of four types of laser light forming images in yellow (Y), cyan (C), magenta (M), and black (K), from each light source to the image-forming unit 13.

The image-forming unit 13 is arranged further downstream than the cleaning device 15 in the moving direction of the intermediate transfer belt 14 (indicated by the arrows in FIG. 1), and forms an electrostatic latent image of a toner image in each color to be transferred to the printing paper P with the laser lights irradiated from the laser scanner unit 12. Specifically, the image-forming unit 13 includes a yellow image-forming unit 13Y, a cyan image-forming unit 13C, a magenta image-forming unit 13M, and a black image-forming unit 13K arranged in series at fixed intervals, and respectively forms toner images in yellow (Y), cyan (C), magenta (M), and black (K) with the laser lights irradiated from the laser scanner unit 12. The image-forming unit 13 is described in more detail later.

The intermediate transfer belt 14 is a belt on which the toner images formed by the yellow image-forming unit 13Y, the cyan image-forming unit 13C, the magenta image-forming unit 13M, and the black image-forming unit 13K are transferred, and is stretched tightly by a drive roller 14*a*, a driven roller 14*b*, and a tension roller 14*c*. Specifically, the intermediate transfer belt 14 is an endless belt with a resistance of approximately 10.5 in log (Ω·cm), and has a three-layer structure formed by providing an elastic layer of NBR rubber (thickness 0.3 mm) on a base material of PVDF resin (thickness 0.1 mm) and providing a coating layer of PTFE (thickness 10 μm) on the surface of the elastic layer.

Primary transfer rollers T1 to T4 are provided in respective correspondence with the yellow image-forming unit 13Y to the black image-forming unit 13K, and a secondary transfer roller T10 is provided opposite the drive roller 14*a*. Specifically, each of the primary transfer rollers T1 to T4 has a diameter of 20 mm and includes EPDM foam provided to a metal shaft with a diameter of 8 mm. The secondary transfer roller T10 has a diameter of 24 mm and includes EPDM foam provided to a metal shaft with a diameter of 10 mm.

The cleaning device 15 is disposed so that, together with the driven roller 14*b*, the cleaning device 15 nips the intermediate transfer belt 14. The cleaning device 15 cleans and removes residual toner from the intermediate transfer belt 14 (residual toner that has remained on the face where the toner image is formed (image-carrying face)). As is described later, the cleaning device 15 also expels irregular toner among toner removed from the intermediate transfer belt 14, such as toner that is charged to the reverse polarity and uncharged toner, toward the intermediate transfer belt 14.

The fixing device 16 includes a heat roller, a fuser roller, a pressure roller, and the like, and fuses the toner image transferred from the intermediate transfer belt 14 onto the printing paper P (a full-color toner image) by heating and pressing the transferred toner image. The upper part of the apparatus body 1*a* is a paper outlet tray 17 for holding printing paper P that an image has been printed on, and a manual bypass tray 18 is provided in a side part of the apparatus body 1*a*.

Image-Forming Unit

Figure 2:
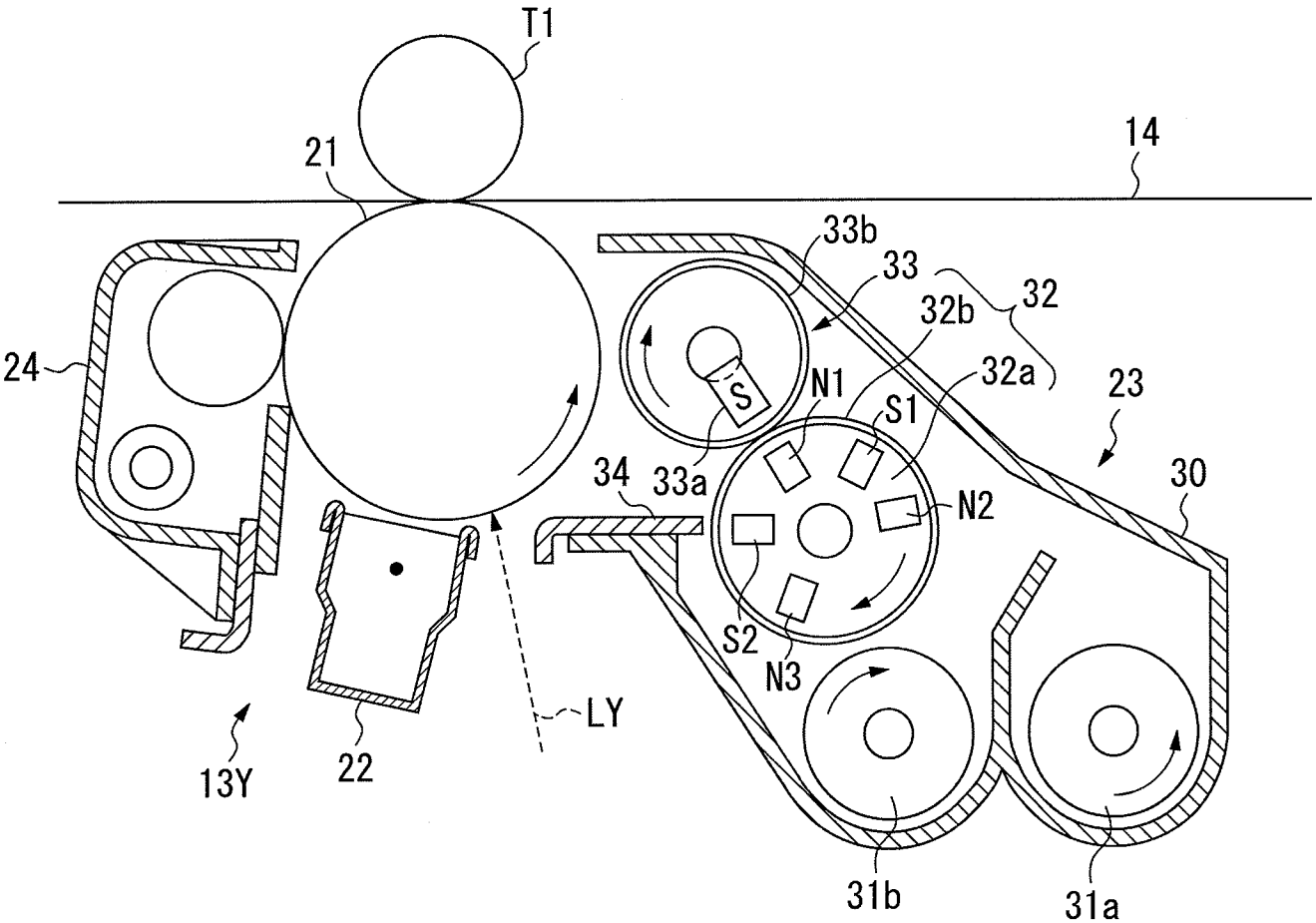
FIG. 2 is a cross-sectional diagram showing the configuration of an image-forming unit in an embodiment of the present disclosure.

FIG. 2 is a cross-sectional diagram of the configuration of the yellow image-forming unit 13Y in an embodiment of the present disclosure. Since the yellow image-forming unit 13Y, the cyan image-forming unit 13C, the magenta image-forming unit 13M, and the black image-forming unit 13K of the image-forming unit 13 have the same configuration, the description below will take the yellow image-forming unit 13Y as an example.

As shown in FIG. 2, the yellow image-forming unit 13Y includes a photosensitive drum 21, a charging unit 22, a developing device 23, and a drum-cleaning device 24 (collecting device). Laser light LY (laser light for forming a yellow (Y) image) is irradiated from the laser scanner unit 12 to the yellow image-forming unit 13Y.

The photosensitive drum 21 is a cylindrical photoconductor having a photosensitive layer of amorphous silicon (a-Si) on its surface, where an electrostatic latent image corresponding to the yellow (Y) image is formed by irradiation of the laser light LY from the laser scanner unit 12 at a width of approximately 300 mm in the axial direction. The photosensitive drum 21 is disposed so that, together with the primary transfer roller T1, the photosensitive drum 21 nips the intermediate transfer belt 14, and is rotated at a predetermined process speed (in the present embodiment, 150 mm/sec) in the direction indicated by the arrows in FIG. 2 (the counterclockwise direction in FIG. 2) by a motor (not shown). The charging unit 22 uniformly charges the surface of the photosensitive drum 21 to a predetermined charge with a charging bias applied from a charging bias power supply (not shown).

The developing device 23 includes agitation screws 31*a* and 31*b*, a magnetic roller 32, a developing roller 33, and the like, in a developing tank 30. The developing device 23 stores a yellow (Y) developing agent, and forms a yellow (Y) toner image by affixing toner to an electrostatic latent image formed on the photosensitive drum 21. The developing agent stored in the developing device 23 is a two-component developing agent including a toner and a carrier, a non-magnetic toner being used.

The agitation screws 31*a* and 31*b* are spiral-shaped members for agitating the yellow (Y) developing agent stored in the developing tank 30. The magnetic roller 32 includes a fixed magnet roller 32*a* including a plurality of magnetic poles N1 to N3, S1, and S2, and a non-magnetic rotation sleeve 32*b* that internally includes the fixed magnet roller 32*a*. The fixed magnet roller 32*a* is cylindrical, and the non-magnetic rotation sleeve 32*b* has the shape of a circular ring. A magnetic brush made from a two-component developing agent is provided on the outer peripheral face of the non-magnetic rotation sleeve 32*b*.

The developing roller 33 includes a non-magnetic circular-ring-shaped rotation sleeve 33*b* that internally includes a magnetic magnet 33*a* facing the magnetic roller 32. When the toner is transported from the magnetic roller 32, a toner layer for developing the electrostatic latent image formed on the photosensitive drum 21 is formed on the outer peripheral face of the rotation sleeve 33*b*. A doctor blade 34 is a member for restricting the layer-thickness of the developing agent, and is attached to the developing tank 30 along the axial direction of the rotation sleeve 32*b* (the direction perpendicular to the drawing sheet of FIG. 2).

The drum-cleaning device 24 cleans the photosensitive drum 21 by removing toner that is not transferred onto the intermediate transfer belt 14 and remains on the photosensitive drum 21. Waste toner that the drum-cleaning device 24 removes from the outer peripheral face of the photosensitive drum 21 passes along a predetermined route and is collected in a toner collection bottle (not shown). The drum-cleaning device 24 also collects toner expelled toward the intermediate transfer belt 14 by the cleaning device 15 as mentioned above.

Cleaning Device

Figure 3:
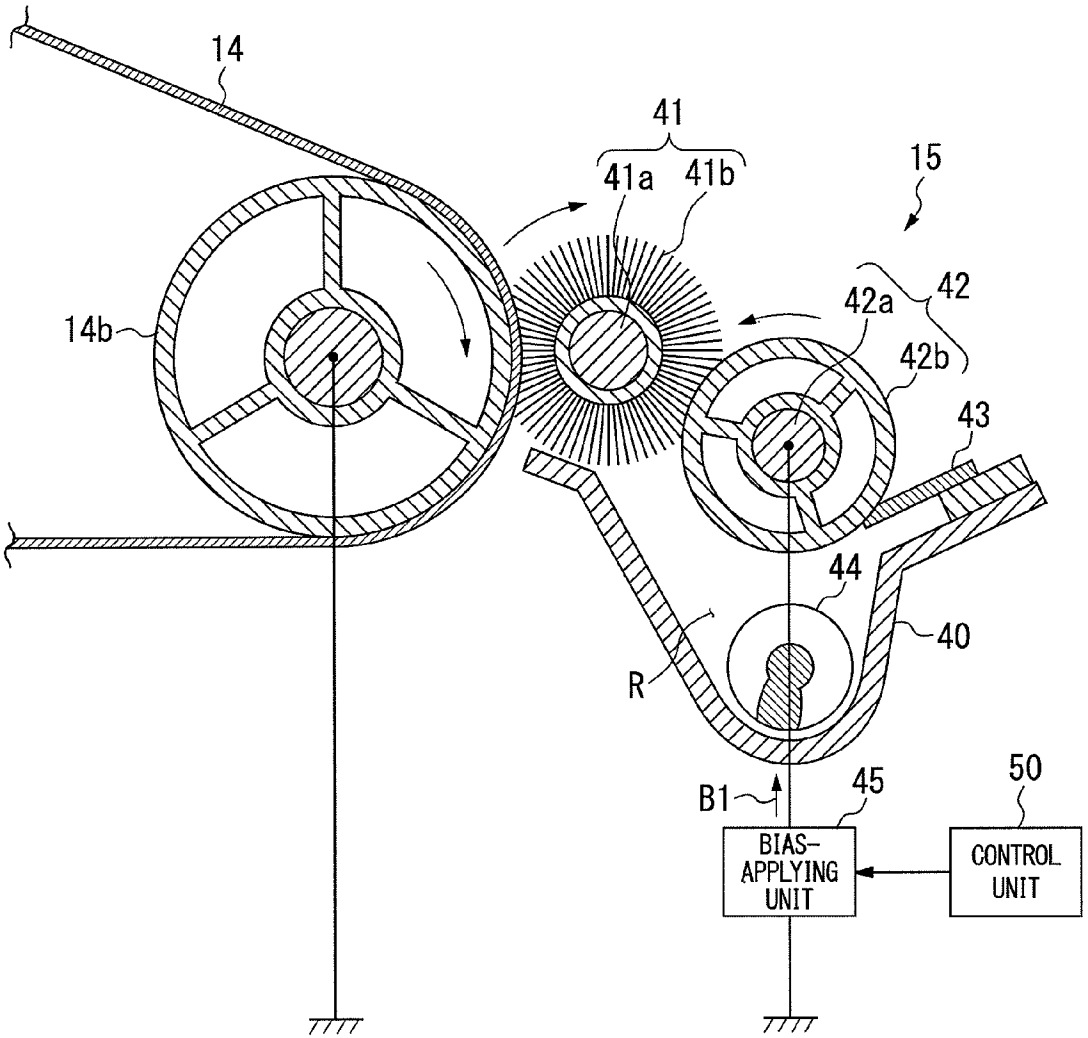
FIG. 3 is a cross-sectional diagram showing the configuration of a cleaning device in an embodiment of the present disclosure.

FIG. 3 is a cross-sectional diagram of the configuration of the cleaning device 15 in an embodiment of the present disclosure. As shown in FIG. 3, the cleaning device 15 includes a casing 40, a fur brush roller 41 (cleaning member), a collection roller 42, a cleaning blade 43, a spiral conveyor 44, and a bias-applying unit 45. The casing 40 is arranged below the fur brush roller 41 to the cleaning blade 43. Residual toner removed from the intermediate transfer belt 14 is received by the casing 40 and collected in the collection bottle (not shown).

The fur brush roller 41 includes a brush shaft 41*a* and a fur brush body 41*b*. The fur brush body 41*b* abuts against the surface of the intermediate transfer belt 14 and removes residual toner remained on the intermediate transfer belt 14. The brush shaft 41*a* is a metal shaft with a diameter of 10 mm. The fur brush body 41*b* is fitted onto the brush shaft 41*a*, and they rotate together in the direction of the arrow in FIG. 3 (clockwise in FIG. 3). The fur brush body 41*b* includes brush hairs of, for example, conductive acrylic or nylon, which are planted evenly in the peripheral face of a base fabric of synthetic resin wound around and attached to the brush shaft 41*a*. In the present embodiment, conductive acrylic brush hairs are planted in the fur brush body 41*b*, which results in an outer diameter of the fur brush body 41*b* to be 19 mm.

The collection roller 42 includes a collection roller shaft 42*a* and a collection roller body 42*b*. The collection roller body 42*b* abuts against the surface of the fur brush body 41*b* and collects residual toner that is removed from the intermediate transfer belt 14 from the fur brush body 41*b*. The collection roller body 42*b* is fitted onto the collection roller shaft 42*a*, and they rotate together in the direction of the arrow in FIG. 3 (counterclockwise in FIG. 3). The collection roller body 42*b* is a cylindrical member made from stainless steel (SUS) or aluminum. The present embodiment uses a stainless steel roller with a diameter of 18 mm.

The cleaning blade 43 scrapes off residual toner collected from the fur brush body 41*b* toward the outer peripheral face of the collection roller 42. The cleaning blade 43 is secured to the right edge of the casing 40 in a state where its tip tilts downwards toward the left, so that its left-end upper edge abuts against the outer peripheral face of the collection roller body 42*b*. Therefore, when the collection roller 42 rotates counterclockwise around the collection roller shaft 42*a*, residual toner adhering to the outer peripheral face of the collection roller body 42*b* is scraped off by the cleaning blade 43. In the present embodiment, the cleaning blade 43 is made from urethane rubber and has a thickness of 1.4 mm.

The spiral conveyor 44 is a spiral-shaped member that conveys the residual toner scraped off by the cleaning blade 43 toward the toner collection bottle (not shown), and is arranged with its axis of rotation in the direction perpendicular to the drawing sheet of FIG. 3 such that it can rotate inside a toner-conveying chamber R formed by the casing 40. When the spiral conveyor 44 rotates, the residual toner collected in the toner-conveying chamber R of the casing 40 after being scraped off by the cleaning blade 43 is conveyed in the axial direction (the direction perpendicular to the drawing sheet of FIG. 3).

Under the control of a control unit 50 (see FIG. 4), the bias-applying unit 45 applies a cleaning bias B1 to the collection roller 42. As shown in FIG. 3, the driven roller 14*b* is electrically grounded, the intermediate transfer belt 14 and the fur brush body 41*b* are abutting each other, and the fur brush body 41*b* and the collection roller body 42*b* are abutting each other. Therefore, when the bias-applying unit 45 applies the cleaning bias B1 to the collection roller 42, a bias corresponding to the size of the cleaning bias B1 is applied between the intermediate transfer belt 14 and the fur brush roller 41, and between the fur brush roller 41 and the collection roller 42.

As controlled by the control unit 50, the bias-applying unit 45 applies two types of bias as the cleaning bias B1 to the collection roller 42. The first type of bias is for removing residual toner charged to a normal polarity (first polarity) such that the fur brush roller 41 captures the residual toner from the intermediate transfer belt 14 (first bias: hereinafter 'ordinary bias'). The second type of bias is for making the fur brush roller 41 capture and remove residual toner charged to a normal polarity (first polarity) from the intermediate transfer belt 14, and expel irregular toner, such as toner charged to a reverse polarity (opposite polarity to the normal polarity; second polarity) and uncharged toner, from the fur brush roller 41 toward the intermediate transfer belt 14 (second bias: hereinafter 'refresh bias'). The refresh bias has the same polarity as the ordinary bias, and has a greater value than the ordinary bias.

That is, whichever of the ordinary bias and the refresh bias is applied, residual toner charged to the normal polarity is removed by electrostatic force from the intermediate transfer belt 14 such that the fur brush roller 41 captures the residual toner; the residual toner is then collected from the fur brush roller 41 by the collection roller 42. However, when the refresh bias is applied, electrostatic force forcibly expels irregular toner, such as toner charged to a reverse polarity and uncharged toner, from the fur brush roller 41 toward the intermediate transfer belt 14.

With the electrostatic force of the ordinary bias, it is difficult for the collection roller 42 to collect irregular toner, such as toner charged to a reverse polarity and uncharged toner, among the residual toner removed from the intermediate transfer belt 14 by the fur brush roller 41. If the amount of irregular toner remaining on the fur brush roller 41 increases, it is conceivable that the performance of the fur brush roller 41 will deteriorate and the image-forming quality will decline. For that reason, in the present embodiment, the amount of irregular toner remaining on the fur brush roller 41 is reduced by applying the refresh bias.

The bias-applying unit 45 applies the ordinary bias while the image-forming unit 13 (the yellow image-forming unit 13Y, the cyan image-forming unit 13C, the magenta image-forming unit 13M, and the black image-forming unit 13K) is forming a toner image, and applies the refresh bias as necessary before or after the toner image is formed by the image-forming unit 13. This is to ensure that toner expelled from the fur brush roller 41 toward the intermediate transfer belt 14 by the refresh bias does not adversely affect the toner image formed by the image-forming unit 13. The size of each bias value is described later.

Control System of Image-Forming Apparatus

Figure 4:
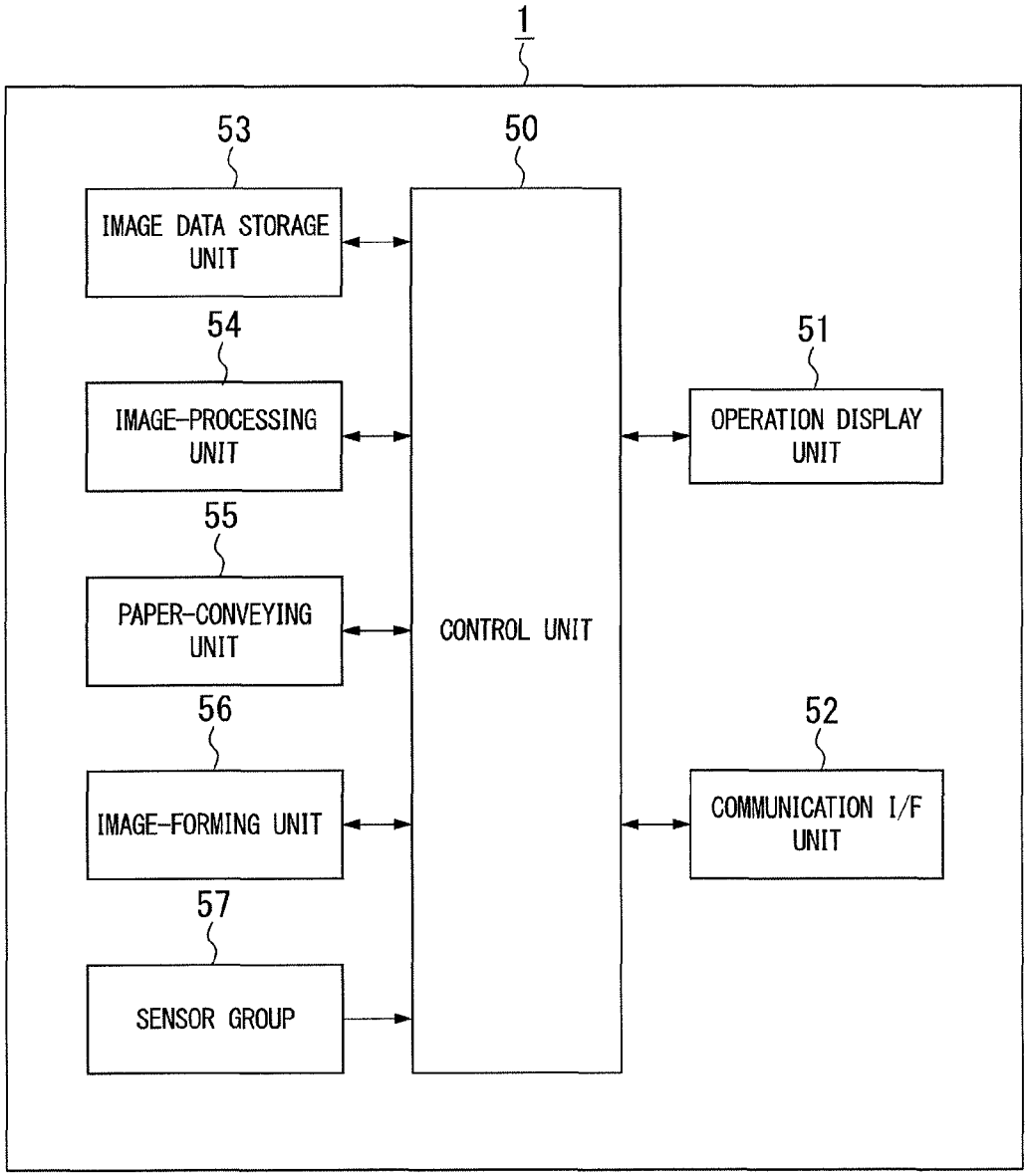
FIG. 4 is a block diagram showing the main configuration of a control system of a color printer as an image-forming apparatus according to an embodiment of the present disclosure.

FIG. 4 is a block diagram showing the main configuration of a control system of a color printer as an image-forming apparatus according to an embodiment of the present disclosure. As shown in FIG. 4, the color printer 1 includes the control unit 50, an operation display unit 51, a communication I/F unit 52, an image data storage unit 53, an image-processing unit 54, a paper-conveying unit 55, an image-forming unit 56, and a group of various sensors 57 (sensor group).

While referring to the various detection signals output from the sensor group 57, the control unit 50 controls the operation of the color printer 1 in accordance with an operation command inputted from the operation display unit 51 or with the various commands inputted from the communication I/F unit 52. For example, the control unit 50 controls the image data storage unit 53 so as to store the image data received at the communication I/F unit 52, and controls printing of the image data stored in the image data storage unit 53. The control unit 50 also controls the bias-applying unit 45 included in the cleaning device 15.

The operation display unit 51 includes a touch panel and various operation keys. The operation display unit 51 outputs operation contents of the operation keys to the control unit 50, and, under the control of the control unit 50, displays various types of information of the touch panel. The communication I/F unit 52 is connected to a client computer (not shown) and a network such as a local area network (LAN) (not shown), and transmits/receives various signals between the client computer and the network.

The image data storage unit 53 temporarily stores image data such as print image data that the communication I/F unit 52 receives from the client computer (not shown) and the network (not shown), or image data that is subject to image processing at the image-processing unit 54. The image-processing unit 54 performs various image processing to the image data stored in the image data storage unit 53, for example, compressing/extending the image data, calculating the coverage rate of the image data, and the like.

The paper-conveying unit 55 includes a conveying roller, a motor for driving the conveying roller, and the like. The paper-conveying unit 55 conveys printing paper P and the like accommodated in the paper-feeding cassette 11 (see FIG. 1) to the image-forming unit 56, and conveys the printing paper P which has been subjected to an image-forming processing at the image-forming unit 56 to the paper outlet tray 17. The image-forming unit 56, under the control of the control unit 50, performs an image-forming processing using image data such as the print image data stored in the image data storage unit 53. Specifically, the image-forming unit 56 transfers toner images corresponding to the various types of image data mentioned above, formed by the image-forming unit 13 on the intermediate transfer belt 14, to the printing paper P conveyed from the paper-conveying unit 55, and uses the fusing device 16 to fuse the toner images. The sensor group 57 includes various types of sensors needed in the image-forming operation, such as a paper-out detection sensor, a paper jam detection sensor, a paper position detection sensor, and a temperature sensor. The various pieces of information detected by the respective sensors are output to the control unit 50 as detection signals.

Operation of Image-Forming Apparatus

Figure 5:
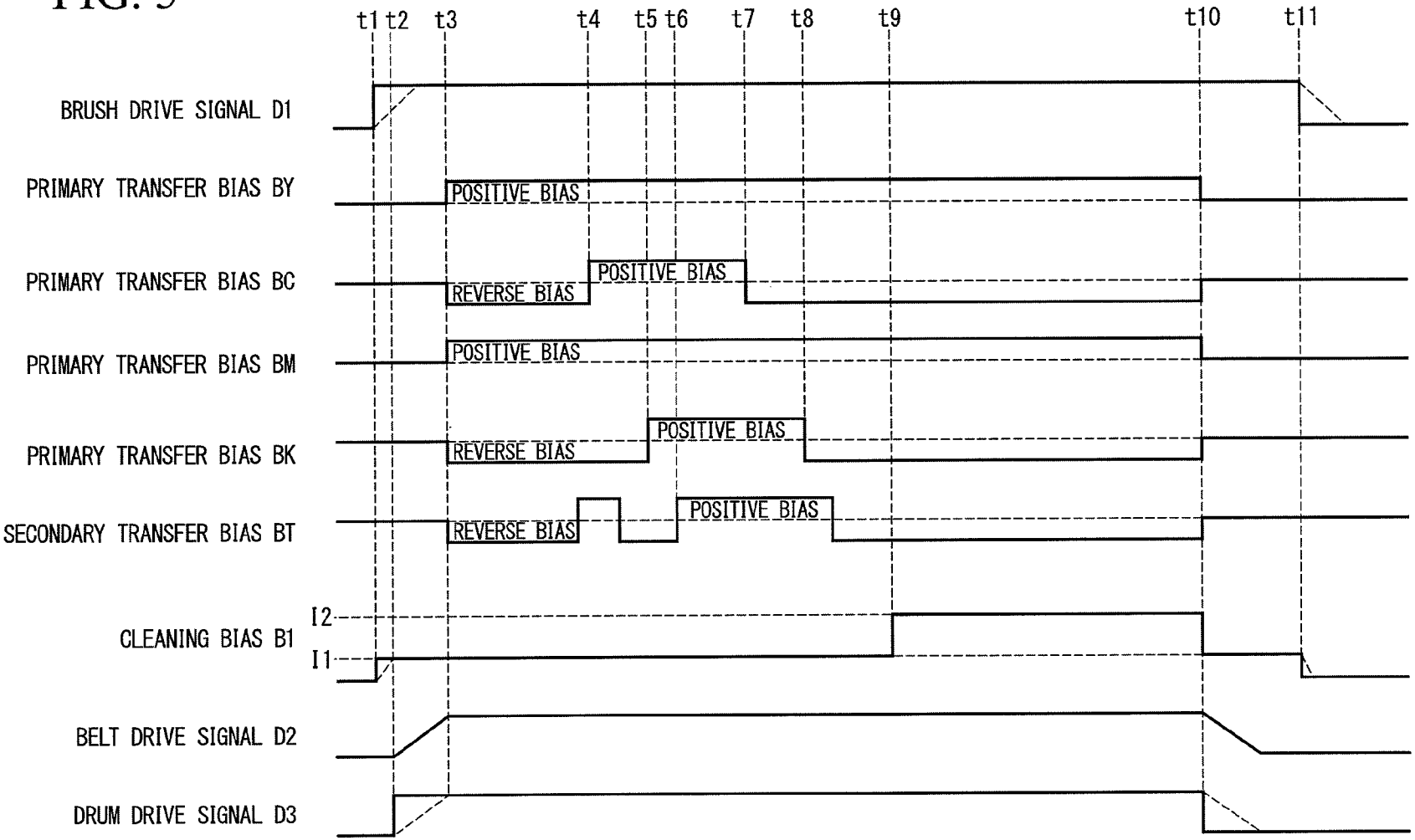
FIG. 5 is a timing chart showing an operation of a color printer as an image-forming apparatus according to an embodiment of the present disclosure.

Subsequently, an operation of the color printer 1 having the configuration described above is described. FIG. 5 is a timing chart showing an operation of a color printer as an image-forming apparatus according to an embodiment of the present disclosure. In FIG. 5, a brush drive signal D1 is a signal for rotating the fur brush roller 41 of the cleaning device 15, a belt drive signal D2 is a signal for rotating the intermediate transfer belt 14, and a drum drive signal D3 is a signal for rotating the photosensitive drums 21 provided in the image-forming unit 13 (the yellow image-forming unit 13Y, the cyan image-forming unit 13C, the magenta image-forming unit 13M, and the black image-forming unit 13K, respectively).

Primary transfer biases BY, BC, BM, and BK are respectively applied to the primary transfer rollers T1 to T4, to transfer the toner images formed by the yellow image-forming unit 13Y, the cyan image-forming unit 13C, the magenta image-forming unit 13M, and the black image-forming unit 13K to the intermediate transfer belt 14. Specifically, as shown in FIG. 5, a positive bias is applied as the primary transfer biases BY and BM, and a positive or negative bias is applied as the primary transfer biases BC and BK.

A positive bias is a bias for transferring a toner image charged to the normal polarity from the image-forming unit 13 to the intermediate transfer belt 14, and for transporting, when toner charged to the reverse polarity is on the intermediate transfer belt 14, the toner to the image-forming unit 13. In contrast, a reverse bias is a bias for transporting, when toner charged to the normal polarity is on the intermediate transfer belt 14, the toner to the image-forming unit 13.

When transferring a toner image charged to the normal polarity from the image-forming unit 13 to the intermediate transfer belt 14, a positive bias is applied as to the primary transfer biases BY, BC, BM, and BK. When a toner image is not transferred, a reverse bias is applied as to the primary transfer biases BC and BK. The positive biases for the primary transfer biases BY, BC, BM, and BK are controlled at −10 μA by constant current control, and the reverse bias is controlled at +500V by constant voltage control.

A secondary transfer bias BT is a bias applied to the secondary transfer roller T10, in order to transfer a toner image on the intermediate transfer belt 14 to the printing paper P. Specifically, a positive bias is applied as the secondary transfer bias BT while the printing paper P passes through the nip region of the intermediate transfer belt 14 and the secondary transfer roller T10 (i.e. while the toner image is being transferred to the printing paper P); at all other times, a reverse bias is applied as the secondary transfer bias BT.

When a reverse bias is being applied as the secondary transfer bias BT, toner charged to the normal polarity is transported to the intermediate transfer belt 14, not to the secondary transfer roller T10. The positive bias for the secondary transfer bias BT is controlled at −30 μA by constant current control, and the reverse bias is controlled at +500V by constant voltage control.

The cleaning bias B1 is a bias applied to the collection roller 42 by the bias-applying unit 45 shown in FIG. 3. The cleaning bias B1 is set at −20 μA or −55 μA by constant current control, as is described in greater detail later. The timings of the signals and applications of biases shown in FIG. 5 are controlled by the control unit 50 shown in FIG. 4.

When printing data representing an image to be printed onto the printing paper P is inputted from outside the apparatus, the printing data is received at the communication I/F unit 52 and is temporarily stored in the image data storage unit 53. The printing data is read out to the image-processing unit 54 and is subject to image processing such as expansion processing. The processed printing data is then stored in the image data storage unit 53. The printing data stored in the image data storage unit 53 is read out to the control unit 50. Under the control of the control unit 50, an image in accordance with the printing data is formed at the image-forming unit 56, and the printing paper P is conveyed by the paper-conveying unit 55.

When the conveying of the printing paper P starts, at time t1 in FIG. 5, under the control of the control unit 50, the brush drive signal D1 is output, and an ordinary bias I1 (−20 μA) of the cleaning bias B1 is applied from the bias-applying unit 45 to the collection roller 42. Consequently, the fur brush roller 41 provided in the cleaning device 15 rotates, and the ordinary bias I1 is applied to the collection roller 42.

At time t2, under the control of the control unit 50, the belt drive signal D2 and the drum drive signal D3 are output. Consequently, the intermediate transfer belt 14 and the photosensitive drums 21 respectively provided at the image-forming units 13 (the yellow image-forming unit 13Y, the cyan image-forming unit 13C, the magenta image-forming unit 13M, and the black image-forming unit 13K) start to rotate.

At time t3 in FIG. 5, the rotation speed of the intermediate transfer belt 14 becomes constant, and, under the control of the control unit 50, primary transfer biases BY, BC, BM, and BK are applied respectively to the primary transfer rollers T1 to T4. At this time, the biases are controlled so that the primary transfer biases BY and BM are positive and the primary transfer biases BC and BK are reversed.

After the primary transfer biases BY, BC, BM, and BK are applied, the yellow image-forming unit 13Y, the cyan image-forming unit 13C, the magenta image-forming unit 13M, and the black image-forming unit 13K sequentially form images. The biases are controlled so that, while the cyan image-forming unit 13C is forming an image between times t4 and t7, and while black image-forming unit 13K is forming an image between times t5 and t8, the primary transfer biases BC and BK are positive.

The yellow image, cyan image, magenta image, and black image thus formed are transferred in sequential overlay onto the intermediate transfer belt 14. This forms a full-color toner image on the intermediate transfer belt 14. At time t3, a reverse bias is applied as the secondary transfer bias BT to the secondary transfer roller T10. This secondary transfer bias BT is switched to a positive bias before time t6 is reached, at a time longer than at least one rotation of the secondary transfer roller T10.

In accordance with the time at which the tip of the full-color toner image formed on the intermediate transfer belt 14 reaches the drive roller 14*a*, a printing paper P conveyed by the paper-conveying unit 55 from the paper-feeding cassette 11 or the manual bypass tray 18 is conveyed to the nip region of the intermediate transfer belt 14 and the secondary transfer roller T10. At time t6 in FIG. 5, under the control of the control unit 50, a positive bias is applied as the secondary transfer bias BT to the secondary transfer roller T10, and the full-color toner image formed on the intermediate transfer belt 14 is transferred to the printing paper P that is conveyed. In this manner, the printing paper P with the full-color toner image transferred thereon is conveyed to the fusing device 16, where the full-color toner image is heat-fused to the surface of the printing paper P by heating and pressing, and the printing paper with the toner image fused thereto is discharged into the paper outlet tray 17.

While the above operation is being performed, residual toner remaining on the intermediate transfer belt 14 is scraped off by the physical force of the fur brush roller 41 provided to the cleaning device 15, and is removed by the electrostatic force of the ordinary bias I1. The residual toner removed from the intermediate transfer belt 14 by the fur brush roller 41 is collected into the collection roller 42 by the electrostatic force of the ordinary bias I1.

After the operation of transferring the toner image to the printing paper P ends and time t9 in FIG. 5 is reached, under the control of the control unit 50, the bias-applying unit 45 applies a refresh bias 12 (−55 μA) as a cleaning bias B1 to the collection roller 42. When the refresh bias 12 is applied, residual toner on the intermediate transfer belt 14 is removed by electrostatic force such that the fur brush roller 41 captures the residual toner; in addition, irregular toner among the residual toner that is removed from the intermediate transfer belt 14 by the fur brush roller 41, such as toner that is charged to the reverse polarity and uncharged toner, is expelled toward the intermediate transfer belt 14.

Toner expelled toward the intermediate transfer belt 14 is transported to the photosensitive drums 21 provided in the image-forming units 13 by the primary transfer biases BY, BC, BM, and BK respectively applied to the primary transfer rollers T1 to T4, and is collected by the drum-cleaning device 24. At time t10 in FIG. 5, under the control of the control unit 50, the application of the primary transfer biases BY, BC, BM, and BK to the primary transfer rollers T1 to T4, and the application of the secondary transfer bias BT to the secondary transfer roller T10, are stopped; in addition, the ordinary bias I1 is applied as the cleaning bias B1 from the bias-applying unit 45 to the collection roller 42.

Under the control of the control unit 50, the belt drive signal D2 and the drum drive signal D3 are stopped, and so is the rotation of the intermediate transfer belt 14 and the photosensitive drums 21 provided in the image-forming units 13. At time t11 in FIG. 5, under the control of the control unit 50, the brush drive signal D1 is stopped, and so is the application of the cleaning bias B1 to the collection roller 42. The fur brush roller 41 provided to the cleaning device 15 thus stops, and the operation series ends.

As described above, in the present embodiment, a refresh bias with the same polarity as the ordinary bias and a greater value than the ordinary bias is applied to the collection roller 42. Consequently, residual toner charged to the normal polarity is removed by electrostatic force from the intermediate transfer belt 14 such that the fur brush roller 41 captures the residual toner; in addition, irregular toner, such as toner that is charged to the reverse polarity and uncharged toner, is expelled from the fur brush roller 41 toward the intermediate transfer belt 14. Toner expelled toward the intermediate transfer belt 14 is collected by the drum-cleaning device 24 provided in the image-forming unit 13.

It is thus possible to prevent a state where toner charged to the reverse polarity and the like accumulates on the fur brush roller 41, and the performance of the fur brush roller 41 deteriorates. It is also possible to prevent a state where toner charged to the reverse polarity and the like is expelled from the fur brush roller 41 toward the intermediate transfer belt 14 while an image is being formed. Moreover, it is possible to prevent a state where toner expelled toward the intermediate transfer belt 14 adversely affects the image-forming quality. As a result, a stable and high-quality image can be formed with simple control, without greatly increasing the cost or the size of the apparatus.

If the refresh bias is applied at power-on, before stopping when the sleep returns, before stopping after printing a fixed number of paper, between paper while continuously printing a fixed number of paper, and at other such times, irregular toner can be expelled from the fur brush roller 41 toward the intermediate transfer belt 14 without interrupting the image-forming operation. Furthermore, if the application time of the refresh bias is changed in accordance with the image conditions, the usage condition of the apparatus, and environmental conditions, the fur brush roller 41 can be maintained in a good state at all times.

Subsequently, a method for appropriately setting the values of the ordinary bias I1 and the refresh bias 12 of the cleaning bias B1 is described. In order to appropriately set the values of the ordinary bias I1 and the refresh bias 12 of the cleaning bias B1, the following experiment is carried out using members with the same specifications as the intermediate transfer belt 14, the fur brush roller 41, and the collection roller 42 used in the color printer 1 in the embodiment of the present disclosure described above.

In assuming a state where, in the color printer 1, the fur brush roller 41 has collected toner and reached a saturated state, a fur brush roller 41 for the experiment is filled with toner in a predetermined charged state until the fur brush roller 41 reaches a saturated state. When the weight of the fur brush roller 41 is measured, the fur brush roller 41 always includes toner of approximately 3.5 g in the saturated state. The fur brush roller 41 in the saturated state is then brought into contact with the intermediate transfer belt 14 in the same state, and the cleaning bias B1 is applied during an aging process of 30 seconds.

After aging, the weight of the fur brush roller 41 is measured again, and the amount of toner removed from the fur brush roller 41 is calculated. Such an experiment is carried out while changing the set value of the cleaning bias B1, with or without the collection roller 42. In the state without the collection roller 42, the cleaning bias B1 is applied to the shaft of the fur brush roller 41, and in the state with the collection roller 42, the cleaning bias B1 is applied to the shaft of the collection roller 42.

Figure 6A:
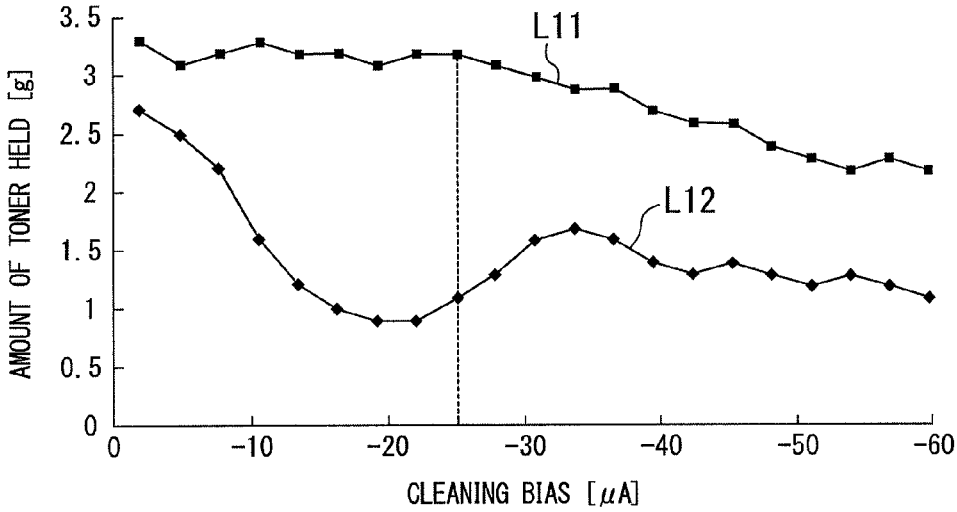
FIGS. 6A and 6B are graphs showing the relationship between size of cleaning bias and amount of toner in an embodiment of the present disclosure.
Figure 6B:
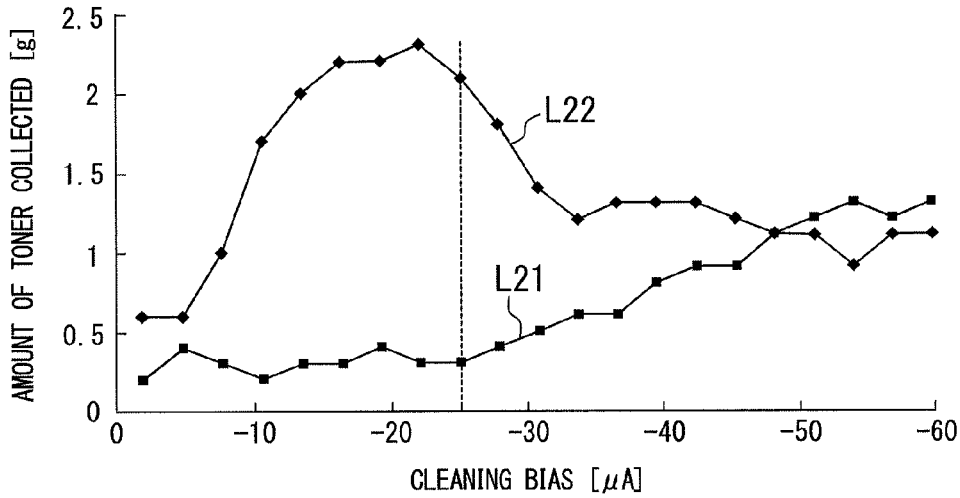

FIGS. 6A and 6B are graphs showing the relationship between the size of the cleaning bias and the amount of toner in the embodiment of the present disclosure. Specifically, FIG. 6A is a graph showing the relationship between the size of the cleaning bias B1 during aging and the amount of toner held on the fur brush roller 41, and FIG. 6B is a graph showing the relationship between the cleaning bias B1 and the collected amount of toner (the amount of toner expelled to the intermediate transfer belt 14 and the amount of toner collected by the collection roller 42).

In FIG. 6A, each value of the graph indicates the amount of toner held on the fur brush roller 41 among the pre-aging saturation amount of toner of 3.5 g after aging is performed as described above, based on changes in the weight of the fur brush roller 41. That is, the value obtained by subtracting the value in the graph from 3.5 g is the weight of the toner removed by the intermediate transfer belt 14 or the collection roller 42. The line shown by reference L11 represents measurement results obtained without the collection roller 42. In this case, the removed toner is presumably expelled from the fur brush roller 41 to the intermediate transfer belt 14 by the cleaning bias B1. The line shown by reference L12 represents measurement results obtained with the collection roller 42. In this case, the removed toner presumably includes toner expelled from the fur brush roller 41 to the intermediate transfer belt 14 by the cleaning bias B1, and toner collected by the collection roller 42.

In FIG. 6B, the line shown by reference L21 is a graph indicating the amount of toner expelled from the fur brush roller 41 toward the intermediate transfer belt 14, and the line shown by reference L22 is a graph indicating the amount of toner collected from the fur brush roller 41 by the collection roller 42. Graph L21 shows the values obtained by subtracting the value of graph L11 in FIG. 6A from the pre-aging saturation toner amount 3.5 g. Graph L22 shows the values obtained by subtracting the value of graph L12 in FIG. 6A and the values obtained by subtracting the values of graph L21 in FIG. 6B from the pre-aging saturation toner amount 3.5 g (i.e. the graph shows the amount of toner presumed to have been collected by the collection roller 42).

Referring to FIG. 6B, when the cleaning bias B1 is less than −25 μA, the amount of toner shown by the graph L21 does not change much despite the change in the cleaning bias B1. However, when the cleaning bias B1 is approximately between −25 μA and −55 μA, the amount of toner increases along with the increase in the cleaning bias B1. This indicates that, when the cleaning bias B1 increases, toner charged to the reverse polarity is expelled from the fur brush roller 41 to the intermediate transfer belt 14.

In contrast, while the amount of toner collected by the collection roller 42 indicated by graph L22 is large when the cleaning bias B1 is approximately between −20 μA and −25 μA, it decreases when the bias exceeds −25 μA. These results indicate that it is preferable to control the ordinary bias I1 of the cleaning bias B1 to between −20 μA and −25 μA during ordinary printing, and, to more effectively collect the positively charged toner in the collection roller 42 and to expel toner charged to the reverse polarity, it is preferable to control the refresh bias 12 to more than −55 μA.

Figure 7:
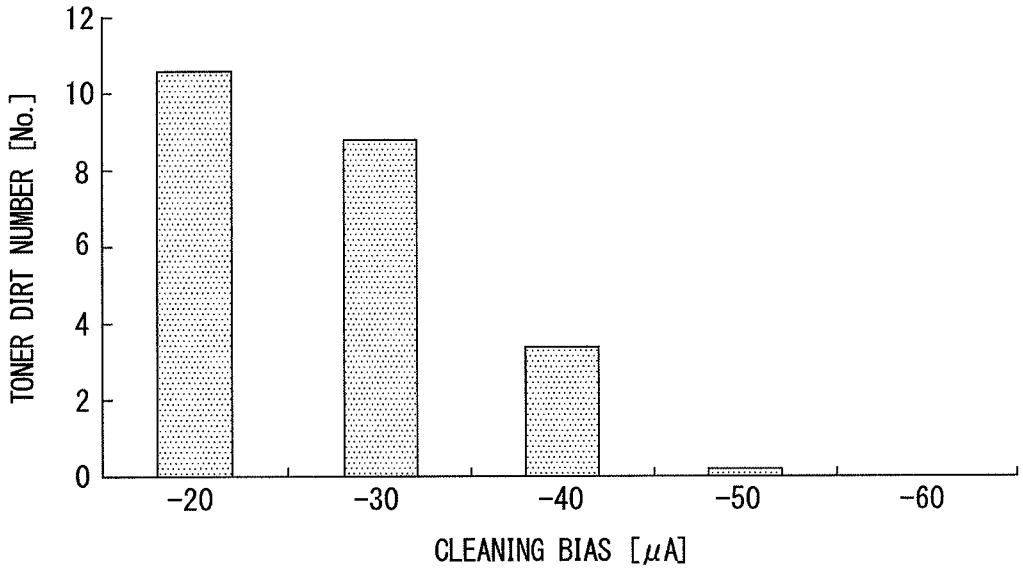
FIG. 7 is a graph showing the relationship between size of cleaning bias and toner dirt number in an embodiment of the present disclosure.

FIG. 7 is a graph showing the relationship between the size of cleaning bias and toner dirt number in an embodiment of the present disclosure. Specifically, FIG. 7 shows average values obtained when the refresh bias 12 is applied for 10 seconds every time 100 sheets of A4-size printing paper P are printed, this operation being repeated ten times for a total of 1,000 printing paper P, the toner dirt number is checked, and this check is repeated five times. Referring to FIG. 7, the toner dirt number decreases in compliance with the increase in the value of the cleaning bias B1. Taking the results of FIGS. 6A, 6B, and 7 into consideration, in the color printer 1 of the specifications described above, the refresh bias 12 is set greater than −25 μA at −55 μA.

While the image-forming apparatus according to an embodiment of the present disclosure has been described above, the present disclosure is not limited to the present embodiment, and modifications can be made freely within the range of the present disclosure. For example, while the foregoing embodiment describes an image-forming apparatus using an intermediate transfer belt as an intermediate transfer member as the image carrier, the present disclosure can also be applied in an image-forming apparatus that does not use an intermediate transfer belt. For example, it can be applied in an image-forming apparatus using a photosensitive drum as a direct transfer member as the image carrier.

What is claimed is:

1. An image-forming apparatus for forming an image on a recording medium comprising:

an image carrier for carrying a toner image corresponding to an image to be formed on the recording medium;

a cleaning device comprising a cleaning member for removing residual toner remaining on an image-carrying face of the image carrier by contacting the image-carrying face while rotating; and a bias-applying unit for switching between a first bias for removing residual toner remaining on the image-carrying face of the image carrier by electrostatic force from the image carrier such that the cleaning member captures the residual toner, and a second bias for expelling residual toner captured by the cleaning member by electrostatic force from the cleaning member toward the image carrier, and for applying the first bias or the second bias between the image carrier and the cleaning member, the polarities of the first bias and the second bias being the same, and the value of the second bias being greater than the value of the first bias.

2. The image-forming apparatus according to claim 1, wherein:

to remove residual toner charged to a first polarity from the image carrier such that the cleaning member captures the residual toner, the polarities of the first bias and the second bias are a second polarity opposite to the first polarity; and the value of the second bias applied between the image carrier and the cleaning member comprises a size that is capable of expelling residual toner charged to the second polarity and captured by the cleaning member toward the image carrier.

3. The image-forming apparatus according to claim 2, further comprising an image-forming unit for forming the toner image corresponding to an image to be formed on the recording medium, transferring the toner image onto the image carrier, and collecting residual toner expelled toward the image carrier by the first bias, the image-forming unit being provided further downstream than the cleaning member in the moving direction of the image carrier.

4. The image-forming apparatus according to claim 3, wherein the image-forming unit comprises:

a photosensitive drum arranged opposite the image-carrying face of the image carrier, an electrostatic latent image of the image to be formed on the recording medium being formed on the photosensitive drum;

a developing device for developing the electrostatic latent image formed on the photosensitive drum to a toner image; and a collecting device for removing and collecting residual toner remaining on the photosensitive drum.

5. The image-forming apparatus according to claim 4, wherein the bias-applying unit applies the first bias while the image-forming unit is forming the toner image, and applies the second bias before or after the image-forming unit forms the toner image.

6. The image-forming apparatus according to claim 3, wherein the bias-applying unit applies the first bias while the image-forming unit is forming the toner image, and applies the second bias before or after the image-forming unit forms the toner image.

* * * * *